United States Patent [19]

Anderson

[11] Patent Number: 4,692,103

[45] Date of Patent: Sep. 8, 1987

[54] PRECISE OUTPUT PUMP SPRAYER

[75] Inventor: Walter F. Anderson, West Covina, Calif.

[73] Assignee: Calmar, Inc., Watchung, N.J.

[21] Appl. No.: 847,453

[22] Filed: Apr. 3, 1986

[51] Int. Cl.[4] ..... F04B 21/04; F04B 39/10

[52] U.S. Cl. ..... 417/547; 222/385

[58] Field of Search ..... 417/550, 559, 486–489, 417/570, 547; 222/385

[56] References Cited

U.S. PATENT DOCUMENTS

| | | | |
|---|---|---|---|
| 4,051,983 | 10/1977 | Anderson | 222/321 |
| 4,088,425 | 5/1978 | Bonnett | 417/550 |
| 4,147,476 | 4/1979 | Warren | 417/445 |
| 4,245,967 | 1/1981 | Busselet | 417/510 |
| 4,344,744 | 8/1982 | Schuster | 417/550 |

*Primary Examiner*—William L. Freeh

*Attorney, Agent, or Firm*—Watson, Cole, Grindle & Watson

[57] ABSTRACT

A pump sprayer has a body with aligned relatively large and small diameter cylinder portions and relatively large and small diameter pistons respectively reciprocable therein and delimiting with the cylinder a variable volume pump chamber during pumping, the small diameter piston shifting relative to the large diameter piston for opening the discharge. Cooperating limit stops acting between the piston members limit the relative movement thereof during a valve open position so as to thereby limit the duration during which the discharge passage is open irrespective of different external reciprocating pressures applied during pumping, such that the output of the sprayer is controlled during pumping.

4 Claims, 5 Drawing Figures

PRECISE OUTPUT PUMP SPRAYER

BACKGROUND OF THE INVENTION

This invention relates generally to a pump sprayer of the pressure build-up variety as set forth in my prior U.S. Pat. No. 4,051,983, and more particularly to such a pump sprayer as having a precise output feature.

In such pump, the pump chamber is provided at its inner end with a reduced diameter portion for the reception of a reciprocable small diameter control piston, against which the return spring exerts an upward force, so that a discharge valve carried by the control piston is urged into a seated position relative to a discharge passage extending through the main pump piston which reciprocably operates within a large diameter portion of the pump chamber. In addition to seating the discharge valve, the thrust of the return spring, transmitted through the control piston and discharge valve, serves to raise both pistons on their intake or suction stroke, following each manually applied downward or compression stroke. The pistons therefore delimit opposite ends of a dual diameter pump chamber the volume of which is varied during pumping, while relative movement between the pistons, resulting from pressure changes within the pump chamber, effects the opening and closing of the discharge valve. Thus, the pressure of the return spring maintains the discharge valve closed or seated except when the pressure of liquid in the pump chamber acting on the control piston exceeds the spring pressure required to seat the discharge valve. And, the pump is primed by the provision of a protuberance or groove in the wall of the reduced diameter pump chamber to effect reverse flow of entrapped air from the pump chamber into the liquid supply container as a piston seal on the control piston engages the protuberance or the groove.

However, experience has shown that the amount of spray discharge varies depending on the amount of external finger pressure applied during pumping, such that a relatively heavy plunger force produces a greater discharge volume compared to the discharge volume sprayed upon application of a relatively lighter plunger force. During pumping upon application of the relatively heavy plunger force, the discharge valve member on the lower control piston is caused to shift a greater distance away from the discharge valve seat during which time the discharge valve remains open for the spray dispensing of a given volume of liquid. However, upon the application of a weaker plunger force during pumping, it has been found that the discharge valve member on the control piston shifts into its open position to a lesser extent as the lower control piston moves relative to the upper main pump piston a lesser amount compared to that upon application of the stronger plunger actuating force. The discharge passage thus remains open a duration of time depending on the difference in the relative travel distance of the discharge valve during a discharge open position. This duration is longer in the presence of relatively heavily applied plunger forces and thereby accounts for a different spray output. This imprecise output is generally unacceptable for those applications of various medicants, for example, requiring metered dosage or controlled output.

SUMMARY OF THE INVENTION

It is therefore an object of the present invention to provide a controlled output feature for the aforementioned pressure build-up pump sprayer by limiting the relative movement of the pistons during a valve open position so as to thereby limit the duration during which the discharge passage is open irrespective of different external reciprocating pressures applied during pumping.

In carrying out this objective, cooperating limit stops are provided on the pistons for limiting the travel of the small diameter control piston and therefore its valve member away from the main pump piston in the valve open position. These limit stops may be in the form of at least one inwardly projecting lug on an inner wall of the discharge passage, and an outwardly projecting lip on the valve member.

Other objects, advantages and novel features of the invention will become more apparent from the following detailed description of the invention when taken in conjunction with the accompanying drawings.

DETAILED DESCRIPTION OF THE INVENTION

Figure 1:
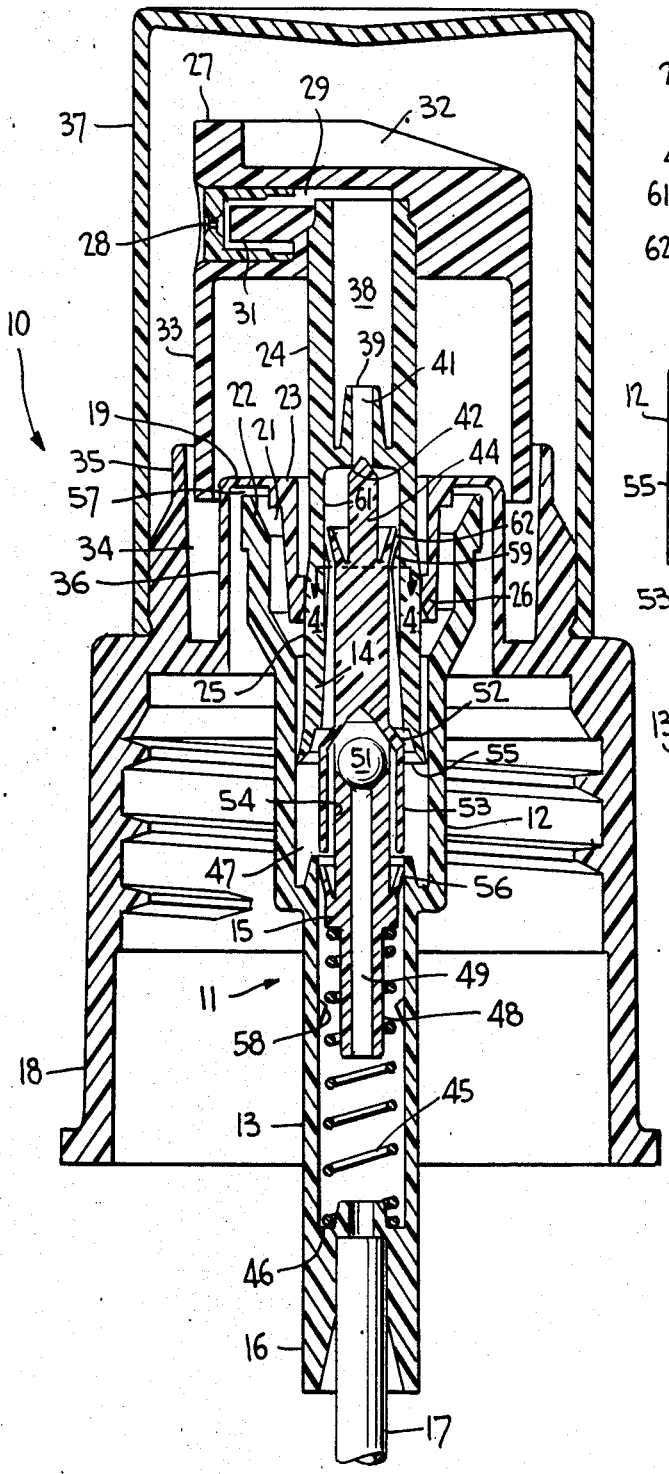
FIG. 1 is a vertical sectional view of a pump sprayer incorporating the precise output feature of the invention.

Turning now to the drawings wherein like reference characters refer to like and corresponding parts throughout the several views, a pump sprayer, generally designated 10 in FIG. 1, is constructed in essentially the same manner as the pump sprayer of my prior U.S. Pat. No. 4,051,983. The entirety of the disclosure thereof is therefore specifically incorporated herein by reference.

The pump sprayer comprises a pump housing 11 which includes a first, upper relatively large diameter portion 12, and an axially aligned, relatively smaller diameter portion 13. A relatively large diameter pump piston member 14 is disposed for reciprocation within body portion 12, and a relatively smaller diameter pump piston member 15 is disposed for reciprocation within body portion 13. Lower end 16 of the pump housing is adapted for communication with a supply of product to be dispensed from a container (not shown) through a dip tube 17 connected to end 16. The opposite or upper end of the pump body is open and is supported by a conventional closure which may be in the form of an internally threaded cap 18. Otherwise, the cap may be of the type so as to be snap-fitted in place over the container neck (not shown). And, the cap is adapted to support the pump body within the interior of the container to dispense the liquid product from the container as desired.

The closure cap has a centrally domed portion 19 which defines an annular downwardly opening recess 21 which receives an upper annular end 22 of the pump body which is secured thereto, as by a suitable snap fit, to retain the pump body in its firmly supported position. The center of the cap has a central opening defined by a depending collar 23 through which a hollow piston rod 24 of the main or large piston 14 is disposed for reciprocation. The lower end of the large piston is outwardly flared as at 25, and the free end of collar 23 has an internal enlargement 26 disposed for sealing against end 25 in the fully raised position of the piston 14 as shown in FIG. 1.

Supported at the upper end of the larger piston is a conventional spray type discharge head 27 having a discharge spray orifice 28 communicating through suitable pasages 29 and 31 with the hollow piston rod for discharging the liquid product to the atmosphere in the form of a fine spray.

An upper surface 32 of the discharge head is conformed to receive downward finger pressure for the purpose of reciprocating the main piston.

The discharge head has a depending cylindrical skirt 33 which is freely reciprocally received within an annular well 34 defined between generally vertical annular walls 35 and 36 formed on top of the closure cap. If desired, a conventional protective overcap 37 may be applied to and either snap fitted or friction fitted onto the lower end of outer wall 35, as shown.

Hollow piston rod 24 defines a discharge passage 38, and a small tube 39 is located on the inner wall of this passage, the tube defining a discharge port 41. A circular edge 42 at the inner end of this port defines a discharge valve seat. This port is normally maintained closed by a discharge valve 44 with its upper end, conical or otherwise, bearing against valve seat 42. Discharge valve 44 is in the form of an elongated solid valve stem carried by small diameter piston 15 for axial movement within hollow piston rod 24, the discharge valve normally being maintained in its closed or seated position by the resilient thrust of a coil spring 45 compressed between the lower piston and a shoulder 46 at lower end 16 of the pump body. However, discharge valve 44 may be unseated whenever the pressure within the pump body between pistons 14 and 15 exceeds the thrust of the spring. The two pistons and that part of the two diameter pump body encompassed between them, define a variable volume pump chamber 47 of dual diameter.

The small diameter piston includes a hollow piston rod 48 which is open for the reception of liquid product from the dip tube through an intake passage 49 controlled by a ball type check valve 51 for preventing back flow of liquid product from pump chamber 47 to the containter. The ball valve is housed and retained for operative movement within a valve cage 52 having a depending skirt 53 with internal axial ribs 54, through which liquid product delivered into the cage through inlet passage 49 may flow into the surrounding pump chamber 47. The liquid then flows upwardly into discharge passage 38 through the open discharge valve, and then through spray nozzle 28 into the atmosphere.

The valve cage constitutes an integral portion of the discharge valve which may be initially formed separately from small diameter piston 15, but which is suitably secured over the upper end of the appropriately formed and proportioned lower piston rod 48, as shown.

Since the dispensed product is compressed within the two diameter pump chamber 47 between the large and small diameter pistons, the resiliently flexible skirts 55 and 56 of these pistons, respectively, will normally be made to extend in opposite relation. Thus, resiliently flexible skirt 55 of the large diameter piston has its free edge directed downwardly, while the resiliently flexible skirt 56 of the small diameter piston has its free edge directed upwardly, the arrangement being well known such that fluid pressure acting against these skirts within the pump chamber will urge them radially outwardly into sliding fluid tight engagement with the cylinder walls.

The pump is also provided with a suitable valve controlled container vent for equalizing the pressures within and outside the container when the pump is in operation, and for interrupting such communication when the pump is in its storage or other position of non-use, to thereby prevent leakage or loss of contents. Thus, when main piston 15 is depressed, air may pass downwardly from the atmosphere through the clearance space between hollow piston 19 and its guide collar 23 to a location within cylinder 12 above the main piston, then may flow through a passageway 57 around the upper peripheral end 22 of the pump body, then downwardly into the container at a location which will be well above the level of liquid therein. However, when main pump piston 15 is in its fully raised position as shown in FIG. 1, such communication is disrupted as enlargement 26 bears against flared end 25 of piston rod 24.

The priming valve structure of the U.S. Pat. No. 4,051,983 may likewise be adopted for the present pump sprayer in that a small ramp or protuberance 58 is provided on the inner wall of small diameter portion 13 so as to engage and inwardly deflect a localized portion of lower piston skirt 56, when such piston is at or near the lower extremity of its downward stroke. A downward flow of entrapped air from pump chamber 47 is thereby permitted to flow into lower portion 13, through dip tube 17 and back into the container. Further details of the construction of protuberance 58 and the accompanying priming feature of U.S. Pat. No. 4,051,983, are omitted for the sake of brevity.

In operation, after the pump is primed, it will function in the manner of a pressure build-up pump. Thus, with pump chamber 47 primed with the liquid product to be dispensed, downward finger pressure on upper surface 32 of the discharge head will initiate downward movement of large diameter piston 14 on its operative stroke. Throughout the initial portion of this stroke, discharge valve 44 will remain seated so as to maintain discharge passage 38 closed by the upper force of spring 45 acting against small diameter piston 15. At the commencement of the downstroke movement of the pistons, the small diameter piston is disposed at the FIG. 1 position. As such movement continues, however, the continuing transfer of liquid from a large diameter cylinder 12 into small diameter cylinder 13 will increasingly compress the liquid product within pump chamber 47. At some location during the compression stroke, the degree of compression of liquid product within the pump chamber will be such that the amount of thrust transmitted to the small diameter piston will exceed the upward thrust of spring 45, with the result that the small diameter piston will move downwardly at a higher velocity as compared to the large diameter piston. This in turn will cause discharge valve 44 to open as it moves away from its valve seat 42, and to remain open as long as such differential pressure is maintained, during which time the liquid product is discharged through the open discharge passage 38 and the spray discharge nozzle. If the pressure drops, however, the discharge valve is automatically closed by the spring pressure to prevent discharge of liquid at a predetermined pressure below that desired.

Thereafter, when finger pressure on the spray discharge head is released, the pistons commence their upward stroke, by energy stored in the spring. Upward movement of the pistons produces a pressure drop in the pump chamber, causing liquid product to be suctioned into the pump chamber via dip tube 17, and intake passage 49 of the small diameter piston rod, in readiness for a further compression stroke.

The foregoing pump structure and its mode of operation are generally conventional, but have been briefly described to better promote an understanding of the present invention.

Figure 2:
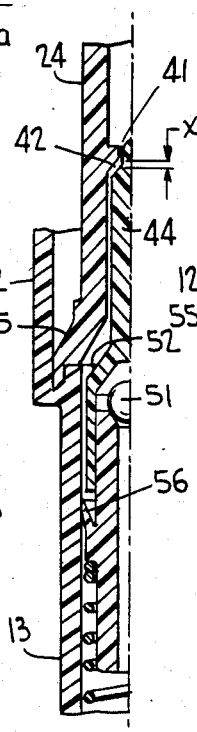
FIG. 2 (PRIOR ART)
FIGS. 2 and 3 are vertical, half sectional views of a portion of a prior art pump sprayer illustrating different travel distances of the open discharge valve during pumping.

During the pumping operation as aforedescribed, it has been noted that the volume of discharge of a given liquid product will differ depending on the amount of finger pressure applied to the spray discharge head. Thus, upon application of a relatively slight finger pressure on the spray discharge head during pumping, discharge valve 44 will be caused to open in the manner described above as it moves away a predetermined distance x from its valve seat, as illustrated in FIG. 2. This separation distance will essentially be maintained so long as the pressure within the pump chamber exceeds the return force of the spring, and continues until the large diameter piston "bottoms out" against the inner end of the large diameter pump body portion 12. FIG. 2 illustrates the separation distance x of the discharge valve just prior to or at the bottoming out of piston 14. Of course, depending on the user and the type of product to be dispensed, the length of the large diameter piston stroke may be shorter during pumping so as not to bottom out.

Assuming the large diameter 12 does bottom out during pumping as illustrated in FIG. 2, that which is discharged through open discharge passage 38 and the discharge orifice includes the swept volume of product in large pump body portion 12 plus the swept volume of product from within small diameter pump body portion 13 as the small diameter piston shifts upwardly a distance equal to x into its discharge valve closing position.

Figure 3:
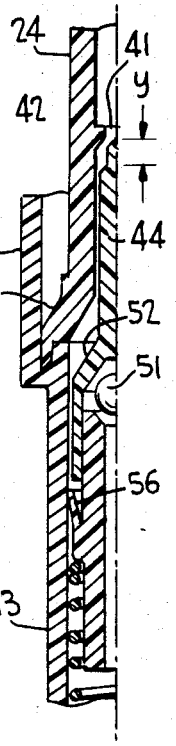
FIG. 3 (PRIOR ART)

On the other hand, upon the application of a relatively heavier finger pressure on the spray discharge head during pumping of the same product, it has been noted that the small diameter piston together with its discharge valve will shift relative to the large diameter piston a distance y (FIG. 3) away from its valve seat 42, the distance y being greater than the distance x described with reference to FIG. 2. Upon application of such relatively heavier finger pressure, the pressure within the pump chamber build up relatively faster than under application of a slighter finger pressure, such that the small diameter piston tends to accelerate slightly faster during its separation movement away from the large diameter piston. Or, the small diameter piston, upon application of such relatively heavy finger pressure, separates at the greater distance y under its own momentum as it receives a rather abrupt heavy pressure force attending application of the relatively heavy finger pressure. Again, this separation distance y, given in the FIG. 3 illustration, will prevail until piston 14 bottoms out, and the pump parts in FIG. 3 are shown with the discharge valve open just prior to or at the bottoming out of piston 14. Of course, the piston need not bottom out during pumping depending on the requirements of the user and the type of product being dispensed.

Assuming a bottoming out of piston 14 in the FIG. 3 illustration, the swept volume of pressurized product within large diameter pump body portion 12 will be discharged through the open discharge passage and discharge orifice, plus the swept volume of pressurized product within the small diameter pump body portion 13 as the discharge valve moves upwardly through a distance y until it reseats against its discharge valve seat. Since the distance y is greater than the distance x, it can be seen that a slightly greater volume of product is expelled from the pump chamber upon application of a relatively heavier finger pressure (FIG. 3) as compared to the application of a relatively lighter finger pressure (FIG. 2). This difference in volume of discharged product is quite acceptable for most applications of liquid products such as detergents, starches, window cleaners, etc. However, this inconsistent volume of discharged product is unacceptable when spray discharging certain liquid products such as medicants into the mouth of the user, for example, when a precise output or metered dosage of medicant is required for each full stroke of the main piston. Present invention is therefore specifically directed to avoiding this problem by controlling the opening distance of the discharge valve to assure that it separates from its valve seat at least the same minimum distance during pumping irrespective of whether a relatively light or heavy finger pressure is applied to the spray discharge head.

Figure 4:
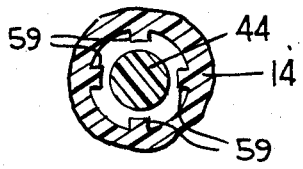
FIG. 4 is a cross-sectional view taken substantially along the line 4—4 of FIG. 1.

Returning to FIG. 1 of the drawings, the invention simply provides for limiting the travel of the small diameter piston and its discharge valve after the discharge valve shifts into an open position away from its valve seat. Such travel limitation of the small diameter piston is effected by the provision of at least one inwardly projecting lug 59 located on inner wall 61 of hollow piston rod 24 which may be located upstream of the discharge valve seat. As shown in FIG. 4, several of such lugs, such as a total of four, may be so provided as equally spaced for stability. And, each of the lugs may have a sloping upper surface as shown in FIG. 1.

Figure 5:
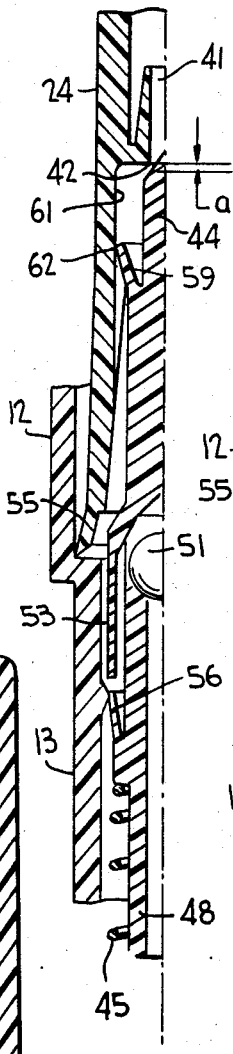
FIG. 5 is a vertical sectional view of a portion of the FIG. 1 sprayer showing the uniform discharge valve open position achieved by the invention.

An annular lip 62 projects outwardly of discharge valve stem 44, the lip having an outer diameter less than the diameter of inner wall 61 so as to avoid any disruption of flow of pressurized product from the pump chamber during discharge. And, the lip is axially spaced in the FIG. 1 position a sufficient distance from the lugs such that, in the valve open position of FIG. 5, lip 62 will engage the lugs to thereby limit the opening of the discharge valve to a minimum distance a, shown in this Figure. The surface of lip 62 which confronts the sloping surfaces of lugs 59 may be similarly sloped for smooth engagement therewith as the difference in pressure between the product in the pump chamber and the return spring force causes the small diameter piston to shift into its FIG. 5 position. Thus, upon application of either a slight finger pressure on the spray discharge head, or a relatively heavy finger pressure thereon, the discharge valve will be shifted open a distance small a sufficient to permit the discharge of pressurized product equal to the swept volume of pump body portion 12 as the main piston bottoms out as shown in FIG. 5, plus the swept volume of product in body portion 13 as the small diameter piston shifts upwardly through a distance a back into its valve closed position. This volume of discharged product is consistent and constant for each full stroke of the main piston during the pumping of the same product, irrespective of light or heavy finger pressures applied to the spray discharge head. Thus, during spray discharge of especially medicants requiring a precise output for each full stroke of the piston, the cooperating limit stops 59 and 62 assure the precise output of product since the combined volume of discharge from the pressure chamber which is delimited by the large and small diameter pistons, is always the same.

From the foregoing, it can be seen that the cooperating limits stops provided for limiting the separation distance of the discharge valve member during pumping thereby limits the duration during which the discharge passage is open during pumping irrespective of different external reciprocating pressures applied, such that the output of the sprayer is controlled during pumping in a simple and efficient yet highly effective manner. Equivalent cooperating limit stops may be provided without departing from the invention, and the cooperating stops may respectively be located on hollow piston rod 24 and the discharge valve stem at locations other than illustrated in the drawings, so long as the cooperating limit stops are initially spaced apart axially in the valve closed position a distance sufficient to limit the shifted open position of the discharge valve to at least a minimum distance from its valve seat. A number of limit lugs may be provided other than that aforedescribed, in addition to at least one.

Terms of orientation, such as "upper", "lower", "upwardly", "downwardly", are used herein for purposes of clarity to identify the orientation relative to the drawings. Such terms are not intended to limit the scope of the invention or to exclude any equivalent structure.

Obviously, many other modifications and variations of the present invention are made possible in the light of the above teachings. It is therefore to be understood that within the scope of the appended claims the invention may be practiced otherwise than as specifically described.

What is claimed is:

1. A pump sprayer comprising, aligned first and second pistons of relatively large and small diameters respectively working in different diameter portions of a common pump chamber having one end thereof adapted for communication with a supply of liquid to be dispensed from a container through a dip tube connected to said one end, a valve controlled discharge passage extending through said first piston from said chamber, a valve controlled inlet passage extending into said chamber, a discharge valve seat in said discharge passage facing said pump chamber, said second piston having a discharge valve member engageable with said valve seat in a valve closed position, said discharge valve member being movable together with said second piston away from said valve seat toward said one end into a valve open position in response to a build-up of pressure within said chamber during pumping, means for reciprocating said pistons, a first limit stop on said valve member, a second limit stop on the wall of said discharge passage spaced from said valve seat a predetermined distance for limiting said movement of said valve member upon interengagement of said stops to thereby control the duration during which said discharge passage is open irrespective of different external reciprocating pressures applied during pumping, whereby the output of the sprayer is controlled during pumping.

2. The pump sprayer according to claim 1, wherein said second limit stop comprises a plurality fo equally spaced inwardly projecting lugs.

3. The pump sprayer according to claim 1, wherein said second limit stop comprises at least one inwardly projecting lug.

4. The pump sprayer according to claim 3, wherein said valve member comprises an elongated valve stem, and said first limit stop on said valve member comprises an outwardly projecting lip located on said stem.

* * * * *